US009346528B2

(12) United States Patent
Webb

(10) Patent No.: US 9,346,528 B2
(45) Date of Patent: May 24, 2016

(54) HAND GRIP AND DEVICE COMPRISING A HAND GRIP

(76) Inventor: Emily Webb, Trellech (GB)

( * ) Notice: Subject to any disclaimer, the term of this patent is extended or adjusted under 35 U.S.C. 154(b) by 597 days.

(21) Appl. No.: 13/138,566

(22) PCT Filed: Feb. 23, 2010

(86) PCT No.: PCT/GB2010/000319

§ 371 (c)(1),
(2), (4) Date: Nov. 21, 2011

(87) PCT Pub. No.: WO2010/100400

PCT Pub. Date: Sep. 10, 2010

(65) Prior Publication Data

US 2012/0060879 A1 Mar. 15, 2012

(30) Foreign Application Priority Data

Mar. 5, 2009 (GB) ..... 0903817.5

(51) Int. Cl.
*B63H 16/04* (2006.01)
*A61H 3/02* (2006.01)

(52) U.S. Cl.
CPC *B63H 16/04* (2013.01); *A61H 3/02* (2013.01); *Y10T 16/476* (2015.01)

(58) Field of Classification Search
CPC ..... Y10T 16/44; Y10T 16/466; Y10T 16/476; B63H 16/04; A61H 3/02; B25G 1/01; B25G 1/10; B25G 1/102; B65D 25/2802; B65D 2525/289; B62K 21/26
USPC ..... 16/421, 430, 110.1; 74/551.9, 558.5; 135/72; 440/101; 220/752, 755
See application file for complete search history.

(56) References Cited

U.S. PATENT DOCUMENTS

| | | | | |
|---|---|---|---|---|
| 4,031,775 | A * | 6/1977 | Petty | 74/551.9 |
| 4,186,924 | A * | 2/1980 | Southey | 473/203 |
| 4,522,083 | A | 6/1985 | Morgan | |
| 4,890,355 | A * | 1/1990 | Schulten | 16/421 |
| 4,964,192 | A | 10/1990 | Marui | |
| 5,339,850 | A | 8/1994 | Mertz | |
| 5,588,243 | A * | 12/1996 | Caldwell | 43/4 |
| 5,692,265 | A * | 12/1997 | Dalury | 16/430 |
| 5,729,864 | A * | 3/1998 | Lie et al. | 16/421 |
| 5,820,424 | A | 10/1998 | Steinhour | |
| 6,135,902 | A * | 10/2000 | Nunez | 473/558 |
| 6,534,747 | B1 * | 3/2003 | Rehrig | 219/137.31 |
| 6,648,535 | B2 * | 11/2003 | Ferrara, Jr. | 401/6 |
| 6,889,405 | B2 * | 5/2005 | Ritrovato et al. | 16/430 |
| 7,219,395 | B2 * | 5/2007 | Bigolin | 16/421 |
| 7,234,205 | B2 * | 6/2007 | Blauer et al. | 16/431 |
| 7,717,292 | B2 * | 5/2010 | Faust, III | 220/755 |
| 8,006,349 | B2 * | 8/2011 | Gill | 16/421 |
| 8,006,352 | B2 * | 8/2011 | Roiser | 16/436 |

FOREIGN PATENT DOCUMENTS

GB 2425762 11/2006

* cited by examiner

*Primary Examiner* — William Miller
(74) *Attorney, Agent, or Firm* — Levy & Grandinetti

(57) ABSTRACT

A hand grip is disclosed. The hand grip has a cross-sectional profile and an axial extent delimited by opposing ends thereof, in which a resilient extension portion is provided at one side of the cross-sectional profile, and which extends substantially the length of the axial extent.

21 Claims, 2 Drawing Sheets

HAND GRIP AND DEVICE COMPRISING A HAND GRIP

This application is the U.S. National Phase of International Application Number PCT/GB2010/00319, filed on Feb. 23, 2010, which claims priority to Great Britain Application Number 0903817.5, filed on Mar. 5, 2009.

The present invention relates to a hand grip, which finds particular, but not exclusive, application as a crutch hand grip, and as a rowing oar handle hand grip.

Crutches commonly comprise an upstanding leg section, an arm engagement part at an upper end thereof, and a handle substantially perpendicular to the leg section, upon which the user places their weight in use. Most users of crutches are not used to placing their weight on their hands, and as a result the prolonged use of crutches can cause discomfort or injury to the hands. Injury can also be caused to the wrist, elbow or shoulder, which may also not be conditioned to carry the weight of the user.

It is known to provide crutch handles with ergonomically shaped hand grips to provide better support for the user's hand. Such shapes can spread the load across the palm and fingers to reduce pressure points. In addition it is known to provide sleeves for crutch handles comprising a resilient material, which compresses in use to provide a degree of suspension.

However, none of the known arrangements provide an adequate solution. Shaped handles have limited application as a user's hands may not fit the shape due to their size, or through disability or malformation. Such handles are also substantially non-resilient in order to maintain their shape, which means they are not comfortable to use, and pressure points may still occur. Resilient handles provide greater comfort, but they offer little support and can wear out quickly. Known resilient handles are also resilient across their whole body, which makes them difficult to grip securely with the fingers.

Rowing and sculling oar handles are generally cylindrical in shape. When user's grip the handles to take strokes the flesh of their hands is compressed in an unnatural way around the cylindrical handle. This does not cause any problems for one or two strokes, but a rower may perform hundreds of strokes a session. In the sport of competitive rowing the user grips the handle with considerable force as all the power provided by their legs, torso and arms in pulling strokes is transmitted through their grip on the handle. This unnatural, repetitive and high force grip is the primary cause of blisters and other skin injuries to rowers' and scullers' hands.

In order to address the problems associated with rowing and sculling oar handles, UK Patent No 2425762, in the name of the applicant discloses a rowing or sculling oar handle in which when the handle is orientated for a stroke it has an axial cross-sectional shape with a greater horizontal extent than vertical extent, and in which an underside of the axial cross-sectional shape is provided with an abutment.

The primary embodiment comprises a handle in which the axial cross-sectional shape comprises a first portion proximal to the user in an in use position, a central portion, and a second portion distal to the user in an in use position, in which the first portion is substantially shaped as more than half an oval, in which the second portion is substantially shaped as less than half an oval, in which a centre of the oval of which the second portion forms a part is vertically lower than a centre of the oval of which the first portion forms a part, in which an upper surface of the central portion follows a smooth line of curvature from the first portion to the second portion, and in which a lower surface of the central portion follows a substantially straight line from the first portion to the second portion.

As such, the handle comprises a ergonomic shape which is similar to the shape of the hand when gripping a rowing oar handle. This results in the load being spread more evenly over the shape of the hand, reducing friction and pressure points. However, the disclosed handle is constructed from solid wood, and as such it is still quite unforgiving and blisters can still occur.

Similar problems to those described above occur with any type of container adapted to carry a load, which has a lifting handle, for example a suitcase, or a wheel barrow. Again, ergonomic and resilient handles have been proposed in these fields to overcome the problems, however none are particularly effective for similar reasons to those described above.

Therefore, according to a first aspect of the present invention a hand grip comprises a cross-sectional profile and an axial extent delimited by opposing ends thereof, in which a resilient extension portion is provided at one side of said cross-sectional profile, and which extends substantially the length of said axial extent.

Thus, in its simplest form the present invention simply comprises a hand grip with a resilient portion on one side, which can be orientated to face the direction the load is applied. As such, the resilient portion can compress to absorb some of the load to reduce friction and pressure points, while the rest of the handle can be firmer to provide a superior gripping surface.

The hand grip of the invention can be any shape, but as the invention is primarily directed to use with rowing oar handles and crutch handles, which are generally annular or ovular in shape, the cross-sectional profile can comprise a first section which comprises a part of a substantially annular or ovular shape comprising a centre. A second section can comprise a greater radial extent from said centre than the first section. As such, the resilient extension portion can stand proud of the rest of the handle.

Preferably the second section of the cross-sectional profile can comprise a tapering section. This shape is suitable because it provides a ridge which the fingers of a rower can comfortably wrap around, or which can fit comfortably into the palm of the hand of a crutch user.

The hand grip can be provided with further ergonomic shaping. In particular, in one embodiment the second section of the cross-sectional profile can comprise a concave section which extends between a first end of the first section and the tapering section. This concave section essentially provides an abutment feature similar to that disclosed in UK 2425762 referred to above, when the hand grip is orientated for rowing. The thumb can rest in the concave section arranged lowermost, and abut against one side of it.

When the hand grip is orientated for use on a crutch the same arrangement can be provided in reverse. The thumb of the user can rest in the concave section, and abut against the opposite side thereof.

The second section of the cross-sectional shape can comprise a convex section which extends between a second end of the first section and the tapering section. When the hand grip is orientated for rowing, this convex section provides a raised section across the top of the hand grip, which fits neatly into the natural shape of the hand which is angled at the knuckles. As the convex section merges into the tapering section, there is provided a broad and generally flat area against which the sections of the fingers between the knuckles and the final joint can rest, and which it is comfortable to pull against.

Again, the same is generally true in the opposite orientation on a crutch handle.

In the cross-sectional profile, the first section, the concave section, the tapering section and the convex section can merge into one another along smooth lines of curvature. This suits the natural shape of the hand and prevents the build up of pressure points.

The resilient extension portion can comprise any resilient material adapted to absorb some of the load applied to the handle, including a resilient material such as rubber or foam. However, in a preferred construction the resilient extension portion can comprise a cavity to provide it with resilience.

The hand grip can be constructed from any suitable material, for example rubber, a rubberised material, a thermoset rubber, or any resilient plastics material. However, in a preferred embodiment the hand grip can be constructed from a thermoplastic elastomer (TPE), and in particular the construction TP50.

Preferably the cross-sectional profile is uniform along said axial extent. This provides a very simple construction, which is suitable to be used by people with various hand sizes and shapes.

The cavity in the resilient extension portion can be open at both ends, which ensures that it has substantially the same levels of resilience along its length.

In a preferred construction the hand grip can comprise a mounting cavity. As such, the hand grip can be fitted to an existing handle, and more importantly can be fitted to any number of different devices as required. This is useful in rowing, as the hand grips can be removed from an actual oar and used on a rowing machine instead.

A wall can extend between the cavity of the resilient extension portion and said mounting cavity, and the mounting cavity can be annular.

The invention also includes any device comprising a hand grip as described above.

Therefore, according to a second aspect of the present invention a device comprising a manually operated load bearing handle is provided with a hand grip according to any of claims 1 to 12 below, and in which the resilient extension portion is arranged facing the direction the load is applied to said handle in use.

In one embodiment the device can comprise a crutch provided with a load bearing handle, and the resilient extension portion can be arranged facing uppermost.

In another embodiment the device can be a rowing or sculling oar comprising a handle, and the resilient extension portion can be arranged on a side of said handle distal to the user.

Alternatively, the device can comprise a container adapted to carry a load, and comprising a lifting handle, and the resilient extension portion can be arranged lowermost.

The invention is not limited to such devices, and could be used on any known handle, including the handlebars of a bicycle or motorcycle, a spade or fork, or even a trapeze.

The invention can be performed in various ways, but one embodiment will now be described by way of example, and with reference to the accompanying drawings, in which.

Figure 1:
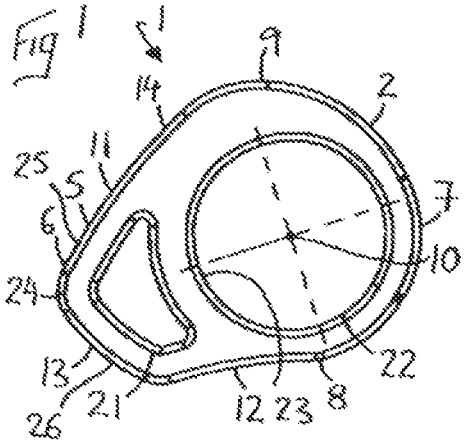
FIG. 1 is an end view of a hand grip according to the invention in a first orientation.

As shown in the Figures, a hand grip 1 comprises a cross-sectional profile 2 and an axial extent delimited by opposing ends 3 and 4 thereof, in which a resilient extension portion 5 is provided at one side 6 of said cross-sectional profile 2, and which extends substantially the length of said axial extent.

Referring to FIG. 1, the cross-sectional profile 2 of the hand grip 1 comprises a first section 7, delimited by a first end 8 and a second end 9, and which comprises a part of a substantially annular shape comprising a centre 10. (This shape is "substantially" annular because it is not completely regular, and is made up of three sections of different radius, as referred to in more detail below. As such the "centre" 10 is not a perfect centre for the first section 7, but it is substantially so.)

A second section 11, which is delimited by the ends 8 and 9, comprises a greater radial extent from said centre 10 than the first section 7. The second section 11 comprises a concave section 12, a tapering section 13, and a convex section 14, which all merge into one another along smooth lines of curvature.

Figure 2:
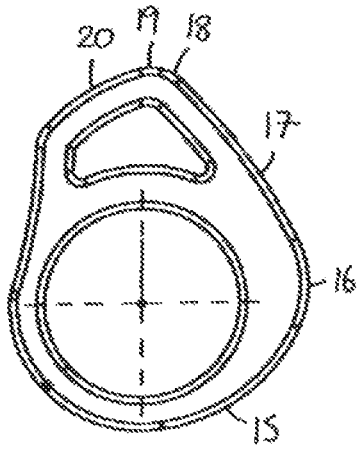
FIG. 2 is an end view of the hand grip shown in FIG. 1 in a second orientation.

In order to arrive at the above described shape, the exterior shape of the hand grip is formed using sections of circles of a given radius, which are indicated in FIG. 2. In particular, the cross-sectional profile comprises sections 15 to 20, which comprise sections of circles with radiuses of 22.49 mm, 15 mm, 80 mm, 7 mm, 5 mm and 26.09 mm respectively.

The resilient extension portion 5 comprises a cavity 21. As is clear from the Figures, the cross-sectional profile 2 is uniform along the axial extent of the hand grip 1, and as such the cavity 21 is also uniform along its length. The cavity 21 is open at both ends. The hand grip 1 is 100 mm in length.

The hand grip 1 is moulded from a single piece of TP50 thermoplastic elastomer (TPE). As such, if a load is placed on the resilient extension portion 5, it deforms as a result of the provision of the cavity 21.

The hand grip 1 also comprises an annular mounting cavity 22, which is also uniform along its axial extent, and is open at both ends. The mounting cavity 22 allows the hand grip to be removably mounted to a load bearing handle with which it is used. The mounting cavity has a radius of 12.9 mm.

As is clear from FIG. 1, a wall 23 extends between the cavities 21 and 22. The wall 23 ensures that the mounting cavity 22 is completely annular and can mount securely to a handle. The wall 23 also ensures that deformation of the resilient extension portion 5 in use is not transmitted to the first section 7, as it is held securely against the handle.

Figure 3:
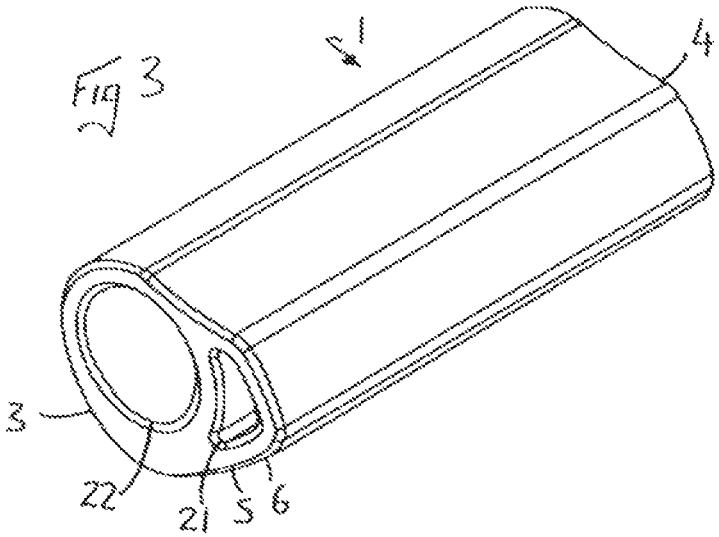
FIG. 3 is a perspective view of the hand grip shown in FIG. 1.
Figure 4:
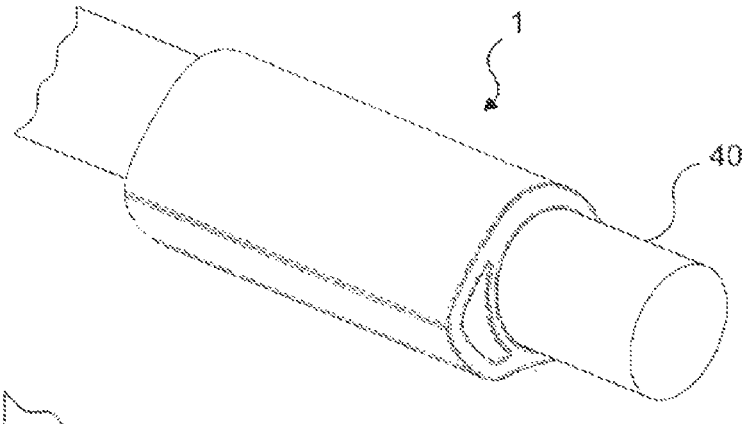
FIG. 4 is a perspective view of the invention of FIG. 3 as used on a known rowing oar handle of the prior art.
Figure 5:
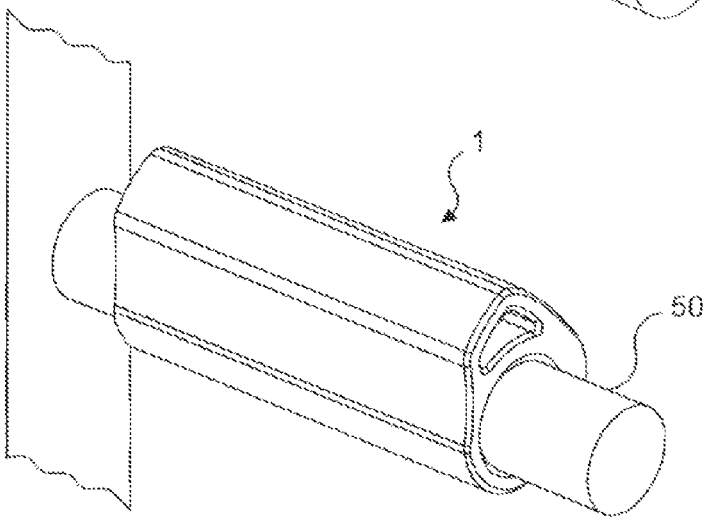
FIG. 5 is a perspective view of the invention of FIG. 3 as used with a known crutch of the prior art.
Figure 6:
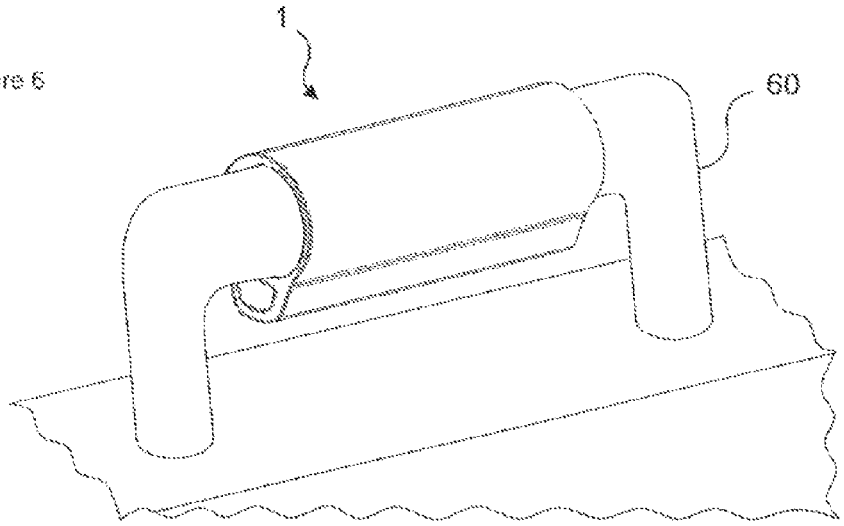
FIG. 6 is a perspective view of the invention of FIG. 3 as used on a known handle of a container in the prior art.

FIG. 3 illustrates the preferred embodiment of the hand grip 1, FIG. 4 illustrates this hand grip 1 on a rowing oar handle 40, FIG. 5 illustrates this hand grip 1 on a crutch 50. FIG. 6 illustrates this hand grip on a handle 60.

In use the hand grip 1 operates as follows. To use the hand grip 1 with a rowing oar (not shown), the mounting cavity 22 is aligned with the existing oar handle, and the hand grip 1 is slid into position thereon. The rotational position of the hand grip 1 can be set to suit, but with the blade of the oar arranged for a stroke, the orientation shown in FIG. 1 is best. (If the rowing oar is intended for rowing with two hands, then two hand grips 1 are fitted at the appropriate positions on the handle where it is gripped in use. If the rowing oar is one of a pair for each hand, then one hand grip 1 is fitted at the appropriate position on each of the two oars.)

In this position the first section 7 is proximal to the user, the resilient extension portion 5 is distal to the user, the convex section 14 is uppermost and the concave section 12 is lowermost. As such, the user's palm is arranged adjacent the first section 7, their knuckles positioned adjacent the second end 9 of the first section, their fingers over the convex section 14 with the ends curled round the tapering section 13, and their thumb arranged in the concave section 12, abutting the side nearest the tapering section 13.

This is a comfortable ergonomic grip which spreads the load across the hand, reducing friction and pressure points. The convex section 14 provides a raised section across the top of the hand grip 1, which fits neatly into the natural shape of the hand which is angled at the knuckles. As the convex section 14 merges into the tapering section 13, there is provided a broad and generally flat area against which the sections of the fingers between the knuckles and the final joint can rest, and which it is comfortable to pull against. The tapering section 13 provides a ridge which the ends of fingers comfortably wrap around. The concave section 12 is shaped to suit the curvature of the thumb, which prevents compression thereof when the hand grip 1 is gripped forcefully, as it is in rowing.

When a rowing or sculling stroke is pulled the load is born by the side 6 of the hand grip 1. As such, the resilient extension portion 5 is compressed and deforms. The end 24 of the tapering section 13 is forced back towards the hand grip 1, and the sides 25 and 26 of the tapering section 13 bow outwards. This cushions the load placed on the fingers of the user, which improves comfort and reduced the occurrence of blisters.

As the hand grip 1 is constructed from a single piece of resilient material, a small degree of resilience is provided by the solid sections of material at the first section 7, the convex section 14 and the concave section 12, which also helps to improve comfort and reduce friction.

As the cross-sectional profile 2 is uniform along the axial extent of the hand grip 1, the hand-grip 1 has a simple shape which is suitable for many different hand sizes and types. The resilient extension portion 5 can deform according to the size and shape of the user's hands applied to it.

In addition, the rotational position illustrated in FIG. 1 can be adjusted in either direction to suit. For example, a user with longer fingers might position the hand grip 1 in an anti-clockwise direction from that shown in FIG. 1, to move the tapering section 13 further around. A user with shorter fingers can position the handle in the opposite direction.

Once a user has finished rowing they can remove the hand grip 1 from the oar by sliding it off the oar handle. As such the hand grip 1 can be used with different oars, for example rowing oars used with two hands, or sculling oars for one hand only. In addition, the hand grip 1 could be placed on the handles of a rowing machine.

To use the hand grip 1 with a crutch (not shown) the mounting cavity 22 is aligned with the crutch handle, and the hand grip 1 is slid into position thereon. The rotational position of the hand grip 1 can be set to suit, but with the crutch in an upright position, the orientation shown in FIG. 2 is best.

In this position the resilient extension portion 5 is proximal to the user and the first section 7 is distal to the user. The convex and concave sections 14 and 12 can be positioned either way around, depending on choice, as either is possible.

If convex section 14 is positioned outermost (which is to say on the right hand side of a right hand crutch), then the user's palm is placed on the tapering section 13, their fingers over the convex section 14 with the ends curled round the first section 7, and their thumb arranged in the concave section 12, abutting the side nearest the first section 7.

This is a comfortable ergonomic grip which spreads the load across the hand, reducing friction and pressure points. The tapering section 13 provides a ridge which fits comfortably into the folded shape of the palm, and in particular at the junction between the thumb and forefinger. The convex section 14 provides an enlarged section down the outside of the hand grip 1, over which the fingers can be placed, bent at their middle joints. The concave section 12 is not well positioned to receive the end of an outstretched thumb, however if the thumb is folded into an "L" shape then the middle joint thereof does fit comfortably into the concave section 12.

If the hand grip 1 is arranged the opposite way around, with the convex section 14 positioned innermost (which is to say on the left hand side of a right crutch), then the user's palm is placed on the tapering section 13, with the section under the knuckles fitting neatly into the concave section 12, and the fingers curled round the first section 7. The user's thumb is placed over the convex section 14.

This is also a comfortable ergonomic grip which spreads the load across the hand, reducing friction and pressure points. Again, the tapering section 13 provides a ridge which fits comfortably into the folded shape of the palm, and in particular at the junction between the thumb and forefinger. The shape of the concave section 12 and the first section 7 conform comfortably to the shape of the palm and the fingers, while the thumb can rest against the convex section 14.

When the crutch is used the weight of the user is born by the side 6, and as such the resilient extension portion 5 compresses and deforms. The end 24 of the tapering section 13 is forced back towards the hand grip 1, and the sides 25 and 26 of the tapering section bow outwards. This cushions the load applied to the palm of the user, which improves comfort and reduced the occurrence of blisters and other injuries.

As the hand grip 1 is constructed from a single piece of resilient material, a small degree of resilience is provided by the solid material at the first section 7, the convex section 14 and the concave section 12, which also helps to improve comfort and reduce friction. As the cross-sectional profile 2 is uniform along the axial extent of the hand grip 1, the hand-grip 1 has a simple shape which is suitable for many different hand sizes and types. The resilient extension portion 5 can deform according to the size and shape of the user's hands applied to it.

Once a user has finished using the crutch they can remove the hand grip 1 from the handle by sliding it off. As such the hand grip 1 can be used with different crutches, as required.

The hand grip 1 can be altered without departing from the scope of claim 1. For example, in one alternative embodiment (not shown) the hand grip can be shaped like any known hand grip, but with a resilient material applied down one side.

In addition, it will be appreciated that the hand grip 1 described above may not fit neatly onto certain existing handles, and therefore in alternative embodiments (not shown) hand grips like hand grip 1 described above are provided, but they comprise mounting cavities of different predetermined shapes and sizes, each adapted to fit onto a particular device handle.

The second aspect of the invention comprises a device comprising a hand grip. The above described uses of the hand grip with a rowing oar and a crutch provide support for this aspect of the present invention, as when those devices are fitted with the hand grip 1 they fall within the definition of the second aspect of the invention.

However, it will be appreciated that other devices are also possible, and the above described embodiments can be altered without departing from the scope of claim 13. For example, in other embodiments of rowing oars and crutches (not shown), the devices are identical to those describe above, except that the hand grips are integrally formed therewith and are not removable.

In other alternative embodiments (not shown) the devices comprise containers adapted to carry a load, which comprise a lifting handle. The resilient extension portions are arranged lowermost on the handle to cushion the user against the load.

Therefore, the present invention provides a simple hand grip with multiple applications with load bearing handles. The resilient extension portion provides adequate dampening where required, while the rest of the handle is comparatively firm to provide greater control. A hand grip is also provided which fits neatly into the shape of the hand without unduly compressing the flesh thereof and causing blisters.

The invention claimed is:

1. A hand grip comprising a cross-sectional profile and an axial extent delimited by opposing ends thereof, in which a resilient extension portion is provided at one side of said cross-sectional profile, in which said resilient extension portion extends substantially the length of said axial extent and comprises an internal cavity to provide said resilient extension portion with resilience, and in which said internal cavity is open at both ends thereof, said hand grip further comprises a mounting cavity, and in which a wall extends between the internal cavity of the resilient extension portion and said mounting cavity.

2. A hand grip as claimed in claim 1 in which the cross-sectional profile comprises a first section which comprises a part of a substantially annular or ovular shape comprising a centre, and a second section comprising a greater radial extent from said centre than the first section.

3. A hand grip as claimed in claim 2 in which the second section of the cross-sectional profile comprises a tapering section.

4. A hand grip as claimed in claim 3 in which the second section of the cross-sectional profile comprises a concave section which extends between a first end of the first section and the tapering section.

5. A hand grip as claimed in claim 4 in which the second section of the cross-sectional shape comprises a convex section which extends between a second end of the first section and the tapering section.

6. A hand grip as claimed in claim 5 in which in the cross-sectional profile, the first section, the concave section, the tapering section and the convex section merge into one another along smooth lines of curvature.

7. A hand grip as claimed in claim 6 in which the cross-sectional profile is uniform along said axial extent.

8. A hand grip as claimed in claim 6, in which said mounting cavity is annular.

9. A device comprising a manually operated load bearing handle, in which said handle is provided with the hand grip according to claim 8, and in which the resilient extension portion is arranged facing the direction the load is applied to said handle in use.

10. A device as claimed in claim 9 in which the device comprises a crutch provided with a load bearing handle, and in which the resilient extension portion is arranged facing uppermost.

11. A device as claimed in claim 9 in which the device is a rowing or sculling oar comprising a handle, and in which the resilient extension portion is arranged on a side of said handle distal to the user.

12. A device as claimed in claim 9 in which the device comprises a container adapted to carry a load, and comprising a lifting handle, and in which the resilient extension portion is arranged lowermost.

13. A device comprising a manually operated load bearing handle, in which said handle is provided with the hand grip according to claim 1, and in which the resilient extension portion is arranged facing the direction the load is applied to said handle in use.

14. A hand grip comprising a cross-sectional profile and an axial extent delimited by opposing ends thereof, in which the cross-sectional profile comprises a first section which comprises a part of a substantially annular or ovular shape comprising a centre, and a resilient extension portion provided at one side of said cross-sectional profile, which is formed by a second section comprising a greater radial extent from said centre than the first section, in which said second section comprises a tapering section and a convex section which extends between a second end of said first section and said tapering section, in which a concave section extends between a first end of said first section and said tapering section, in which said cross-sectional profile is uniform along the length of said axial extent, in which the resilient extension portion comprises a cavity which is open at both ends of said hand grip, and in which in said cross-sectional profile said cavity and said concave section partially overlap with one another in a direction from said centre to said side.

15. A hand grip as claimed in claim 14 in which in the cross-sectional profile, the first section, the concave section, the tapering section and the convex section merge into one another along smooth lines of curvature.

16. A hand grip as claimed in claim 14, in which the hand grip comprises a mounting cavity.

17. A hand grip as claimed in claim 16, in which a wall extends between the cavity of the resilient extension portion and said mounting cavity, and in which said mounting cavity is annular.

18. A device comprising a manually operated load bearing handle, in which said handle is provided with a hand grip according to claim 17, and in which the resilient extension portion is arranged facing the direction the load is applied to said handle in use.

19. A device as claimed in claim 18 in which the device comprises a crutch provided with a load bearing handle, and in which the resilient extension portion is arranged facing uppermost.

20. A device comprising a manually operated load bearing handle, in which said handle is provided with a hand grip according to claim 14, and in which the resilient extension portion is arranged facing the direction the load is applied to said handle in use.

21. A device as claimed in claim 20 in which the device comprises a crutch provided with a load bearing handle, and in which the resilient extension portion is arranged facing uppermost.

* * * * *